United States Patent [19]

Mahlich

[11] Patent Number: 4,835,861

[45] Date of Patent: Jun. 6, 1989

[54] ELECTRIC SHAVER

[75] Inventor: Gotthard Mahlich, Solingen, Fed. Rep. of Germany

[73] Assignee: Robert Krups Stiftung & Co. KG, Solingen, Fed. Rep. of Germany

[21] Appl. No.: 150,393

[22] Filed: Jan. 29, 1988

[30] Foreign Application Priority Data

Feb. 2, 1987 [DE] Fed. Rep. of Germany ..... 3702998

[51] Int. Cl.[4] ..... B26B 19/20

[52] U.S. Cl. ..... 30/43.92; 30/34.1

[58] Field of Search ..... 30/34 R, 34.1, 43, 43.1, 30/43.91, 43.92, 201, 210, 346.51

[56] References Cited

U.S. PATENT DOCUMENTS

| | | | |
|---|---|---|---|
| 3,824,687 | 7/1974 | Baumann | 30/43.92 |
| 3,874,079 | 4/1975 | Waters et al. | 30/43.92 X |
| 4,167,060 | 9/1979 | Sakamoto | 30/43.92 |
| 4,170,060 | 10/1979 | Seidel et al. | 30/43.92 |
| 4,393,585 | 7/1983 | Nagelkerke | 30/34.1 |

*Primary Examiner*—Frank T. Yost
*Assistant Examiner*—Michael D. Folkerts
*Attorney, Agent, or Firm*—Peter K. Kontler

[57] ABSTRACT

An electric shaver wherein the motor housing carries a separable frame for confinement of the cutter and the frame carries a separable casing for an apertured foil which overlies the cutter in assembled condition of the shaver. The frame has a window which is adjacent one side of the cutter and serves for insertion of the casing so that the latter can be attached to or detached form the frame only when the frame is separated from the motor housing. The coupling between the frame and the casing has complementary male and female coupling elements which are designed to confine the casing to movements at right angles to the longitudinal direction of the motor housing. The latter carries a reciprocable slide for a trimmer which can be moved to several positions with reference to the apex of the foil but remains in the general plane of the slide.

23 Claims, 3 Drawing Sheets

FIG.8
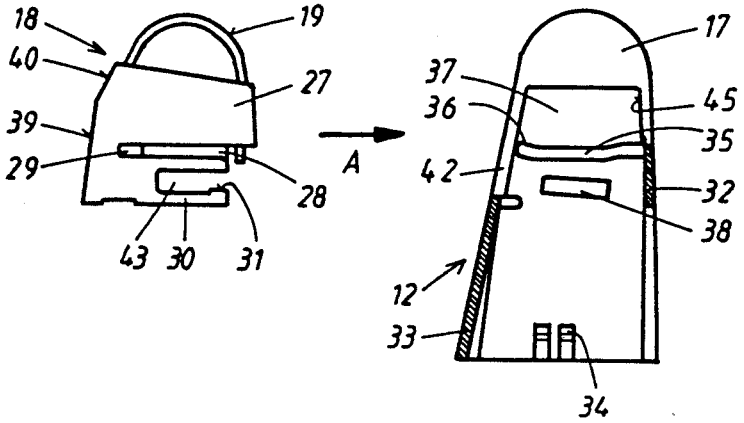
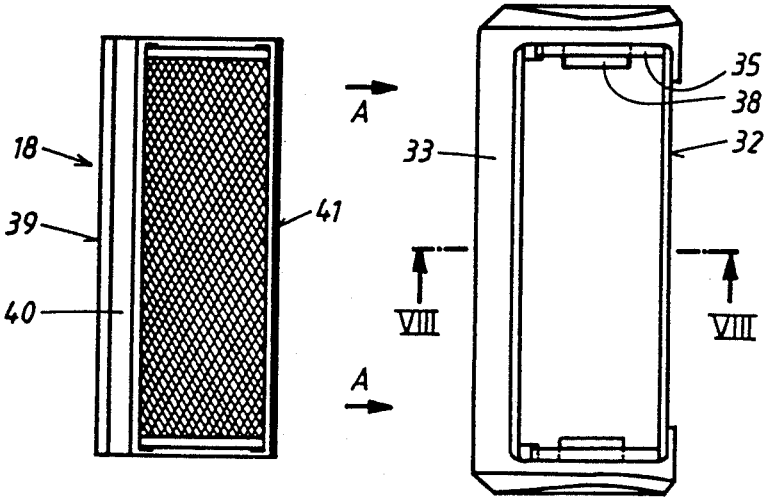
FIG.9

ELECTRIC SHAVER

BACKGROUND OF THE INVENTION

The invention relates to electric shavers or dry shavers in general, and more particularly to improvements in electric shavers of the type wherein the cutter extends from the motor housing and can be confined in a detachable frame which, in turn, can be separably coupled with a casing for an apertured foil serving to permit penetration of whiskers into the interior of the casing and into the range of the cutter when the shaver is in use.

It is known to provide an electric shaver with a frame which can be separably connected to the front portion of the motor housing by suitable detent means and which, in turn, can be separably coupled with a casing for the foil. The arrangement is such that the frame has two spaced-apart cheeks which carry one or more coupling elements for the casing. The latter is movable toward and away from the frame in the longitudinal direction of the motor housing, i.e., toward or away from the front side of the cutter which can be driven by the motor in the housing to sever whiskers which project into the interior of the casing by passing through the apertures of the foil. Thus, the front end of the frame is open and such front end is closed by the properly inserted casing. The casing has spaced-apart lateral walls which flank the foil and carry coupling elements complementary to those on the cheeks of the frame.

In accordance with a presently known proposal, the coupling elements on each lateral wall of the casing include a pair of spaced apart parallel guide ribs and a resilient prong between the ribs. Each prong has a pallet which can engage a complementary part on the respective cheek of the frame when the casing is inserted into the frame in a direction toward the front side of the cutter. The pallets of prongs on the lateral walls of the casing automatically snap behind or into the complementary parts when the insertion of the casing into the frame is completed. The external surfaces of the cheeks on the frame are provided with mobile releasing members which can be depressed in order to disengage the pallets from the complementary parts so as to allow for separation of the casing from the frame, e.g., for the purpose of facilitating cleaning of the foil. A drawback of the just described shaver is that the releasing members are likely to be accidentally depressed, even when the shaver is in use, which can entail unintentional separation of the casing with attendant damage and/or contamination of the foil and spilling of severed whiskers.

The means for separably connecting the frame to the motor housing in the just described shaver also includes depressible and/or otherwise movable disengaging members which are closely adjacent the releasing members for the prongs of coupling elements on the casing. This is likely to confuse the user of the shaver, i.e., the user is likely to detach the frame from the motor housing in lieu of detaching the casing from the frame or vice versa, especially if the disengaging members for the frame are separated from the respective releasing members by narrow gaps so that those fingers of the user of the shaver which are to actuate the disengaging members are likely to simultaneously engage the respective releasing members.

Another drawback of the just described electric shaver is the relatively high cost of the means for connecting the frame to the housing and of the means for coupling the casing to the frame. As a rule, the cheeks of the frame must be provided with openings as well as with fulcra for the releasing members which normally constitute separately produced pivotable levers. The installation of relatively small levers on the frame is a time-consuming operation.

OBJECTS AND SUMMARY OF THE INVENTION

An object of the invention is to provide an electric shaver wherein the casing for the foil is connectable to and is separable from its frame in a novel and improved way.

Another object of the invention is to provide a shaver wherein the casing can be separated from the frame only under certain circumstances so that the user of the shaver is less likely to accidentally separate the casing from the frame.

A further object of the invention is to provide an electric shaver wherein the connections between the frame and the motor housing on the one hand, and the frame and the casing on the other hand, are simpler and less expensive than in heretofore known electric shavers.

An additional object of the invention is to provide an electric shaver wherein the directions of attachment of the casing to and of its detachment from the frame are different from those in conventional shavers and wherein the casing can be uncoupled from the frame only when the frame is already detached from the motor housing.

Still another object of the invention is to provide a novel and improved frame and a novel and improved casing for use in the above outlined electric shaver.

Another object of the invention is to provide novel and improved means for coupling the casing for the foil to the frame.

An additional object of the invention is to provide an electric shaver wherein the trimmer is mounted and manipulated in a novel and improved way.

A further object of the invention is to provide an electric shaver wherein the trimmer can be moved to any one of a plurality of different positions for convenient trimming of side burns or other accumulations of hairs or whiskers without interference on the part of the foil.

Another object of the invention is to provide an electric shaver whose manipulation (including assembly, dismantling and cleaning) is simpler than that of heretofore known electric shavers with separable frames and casings.

The improved electric shaver or dry shaver comprises a motor housing which includes a front or head portion, a mobile cutter which is mounted in the housing and extends beyond the front portion, a hollow frame, means for separably connecting the frame to the housing so that the frame confines the front portion, a hollow casing which includes an apertured foil and is insertable into the frame substantially transversely of the housing so that the foil overlies the cutter when the frame is connected to the housing and the casing is inserted into the frame, and means for separably coupling the casing to the frame. Thus, instead of being movable relative to the frame in directions toward and away from the front portion of the motor housing, the casing of the improved electric shaver is movable relative to the frame substantially transversely of the housing and its front portion; such movement is possible when the frame is detached from the housing because the cutter would prevent the casing and its foil from moving relative to the frame while the latter is still connected to the housing.

The housing is preferably elongated, and the casing can be said to constitute a drawer which is insertable into and removable from the frame in directions substantially transversely of the longitudinal direction of the housing; however, and as explained above, such movements of the casing and its foil are possible only when the frame is detached from the housing so that the cutter does not extend into the casing, i.e., when the foil does not overlie the cutter.

The frame is preferably formed with at least one window for the casing, and such window is adjacent one side of the cutter when the frame is connected to the housing.

The frame can resemble an elongated trough with a first open end which is adjacent the main portion of the housing when the latter is connected with the frame, and a second open end which forms part of the window. The window is flanked by two spaced apart and preferably substantially parallel cheeks, and the coupling means comprises a first set of coupling elements provided on at least one of the cheeks. A second set of coupling elements of the coupling means is provided on the casing for the foil. The coupling elements of the first set are provided at the inner side of the one cheek, i.e., in the interior of the frame; at least one of such coupling elements preferably includes an elongated rib which extends substantially transversely of the housing when the frame is connected to the housing. The coupling elements on the cheek or cheeks of the frame can constitute or comprise male coupling elements including the aforementioned elongated rib which extends substantially transversely of and across the entire one cheek and has a locking portion (e.g., a suitably inclined projection) which is adjacent the window and can snap into an opening of the casing when the latter is inserted into the frame. The male coupling elements can further comprise a second rib which is or can be shorter than the elongated rib and is substantially parallel to and spaced apart from the elongated rib so that the second rib is disposed between the elongated rib and the open rear end of the trough-shaped frame. At least a portion of the second rib can slope toward the open rear end of the frame. The inner side of at least one of the cheeks can be provided with a recess which is adjacent the window, and the cheek which is provided with the recess can be further provided with an internal stop (e.g., a shoulder in the recess at a location which is remote from the window) which is engaged by a portion of the properly inserted casing to thus determine the extent to which the casing is insertable into the frame.

The frame preferably further includes a first wall which extends between the cheeks and a second wall which extends between the cheeks opposite the first wall. The walls are preferably staggered relative to each other in the longitudinal direction of the housing when the frame is connected to the housing. The first wall includes a marginal portion which is immediately adjacent the window in the frame, and the second wall is preferably located opposite the window at or close to the level of the set of coupling elements at the inner side or sides of one or both cheeks of the frame. The second wall is or can be narrower than the first wall.

The coupling elements of the set on the casing can comprise at least one preferably elastic prong which has a detent engageable with the frame, and a groove provided in the casing for the elongated rib of the set of male coupling elements. The prong is preferably parallel to the groove, and the casing is further provided with an open slot which is disposed between the prong and the groove and ca receive the aforementioned second rib of the male coupling elements on the frame. The aforementioned opening preferably communicates with the groove and receives the locking portion of the elongated rib when the casing is properly inserted into the frame. The casing preferably comprises two lateral walls which flank the foil and are provided with the corresponding set of coupling elements including the aforementioned prong or prongs, slot or slots and groove or grooves. The casing can further comprise a relatively wide first intermediate wall which extends between the lateral walls adjacent the foil, and a relatively narrow second intermediate wall extending between the lateral walls opposite the first intermediate wall. The first intermediate wall can be provided with an elongated facet which is adjacent and slopes toward the neighboring marginal portion of the foil.

The shaver preferably further comprises an elongated trimmer for side burns, moustache or beard. Such trimmer is provided on and is movable relative to the housing, and the cutter is preferably inclined toward the trimmer so that the cutter and the trimmer are closely adjacent each other when the trimmer is ready for use. The trimmer preferably extends transversely of the longitudinal direction of the housing, and the cutter preferably slopes in a direction from the front portion of the housing toward the trimmer. The housing can carry a slide which constitutes a means for reciprocating the trimmer relative to the housing and cutter between a plurality of different positions. In one of its positions, the trimmer is preferably adjacent the apex of the customary convex outer side of the foil. Such apex is remote from the housing when the frame is properly attached to the housing and the casing is properly coupled to the frame. The slide is preferably designed to move the trimmer to at least one additional position in which the trimmer extends at least slightly or well beyond the apex of the outer side of the foil in a direction away from the motor housing. The severing elements (such as teeth) of the trimmer can form a row which extends transversely of the longitudinal direction of the motor housing and is disposed in or close to the plane of the reciprocating means.

The novel features which are considered as characteristic of the invention are set forth in particular in the appended claims. The improved shaver itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 8 is an end elevational view of the frame and of the casing in positions they assume prior to insertion of the casing into the frame, the frame being shown in a sectional view as seen in the direction of arrows from the line VIII—VIII in FIG. 9; and FIG. 9 is a plan view of the frame and casing in positions they assume in FIG. 8.

DESCRIPTION OF THE PREFERRED EMBODIMENTS

Figure 1:
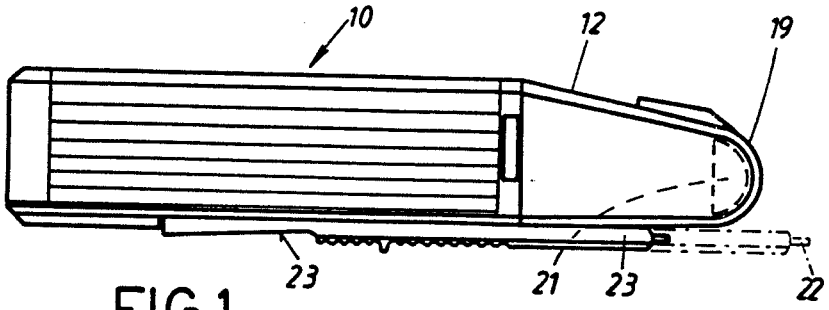
FIG. 1 is a side elevational view of an electric shaver which embodies the invention, with the protective shroud for the foil removed and with the trimmer shown in retracted position by solid lines, an extended position of the trimmer being indicated by phantom lines.
Figure 2:
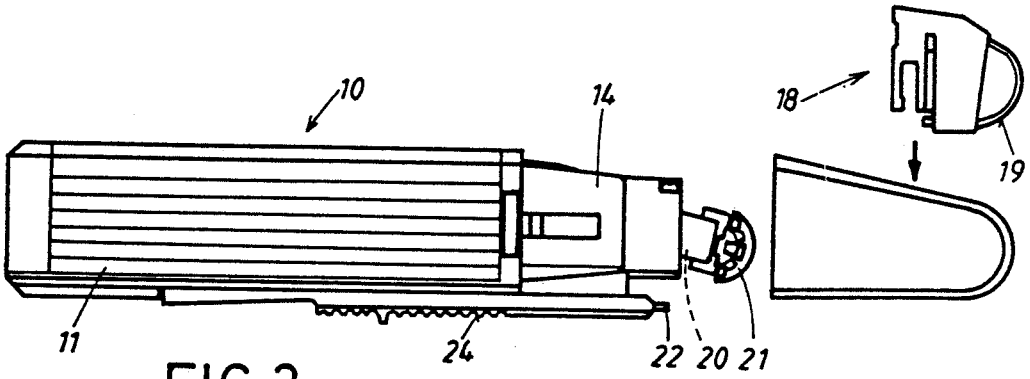
FIG. 2 is an exploded view of the structure of FIG. 1, with the frame detached from the motor housing and with the carrier for the foil uncoupled from the frame.
Figure 3:
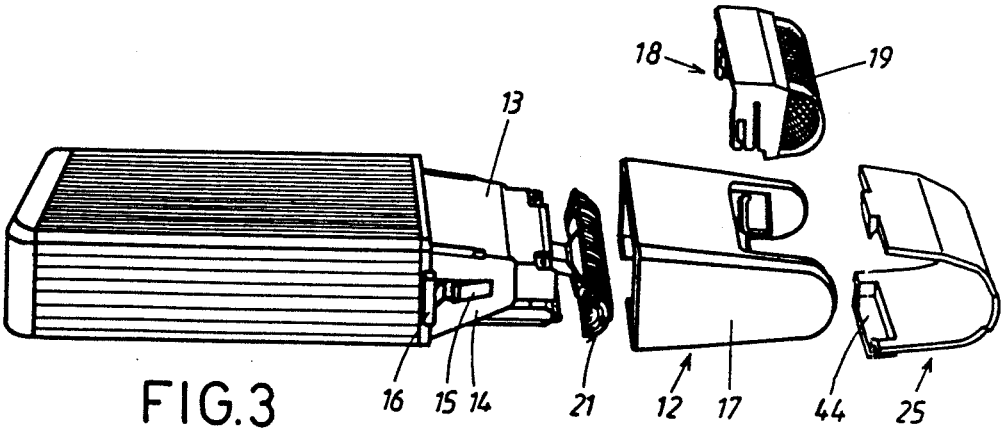
FIG. 3 is a perspective view of the structure which is shown in FIG. 2, and further shows the protective shroud for the foil.
Figure 5:
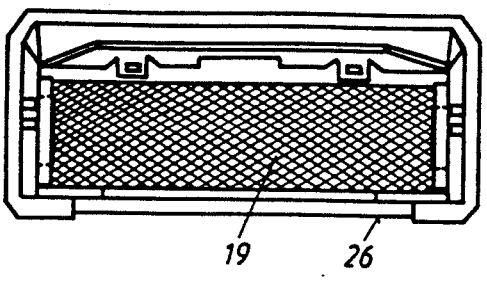
FIG. 5 is a bottom plan view of the structure which is shown in FIG. 4.
Figure 4:
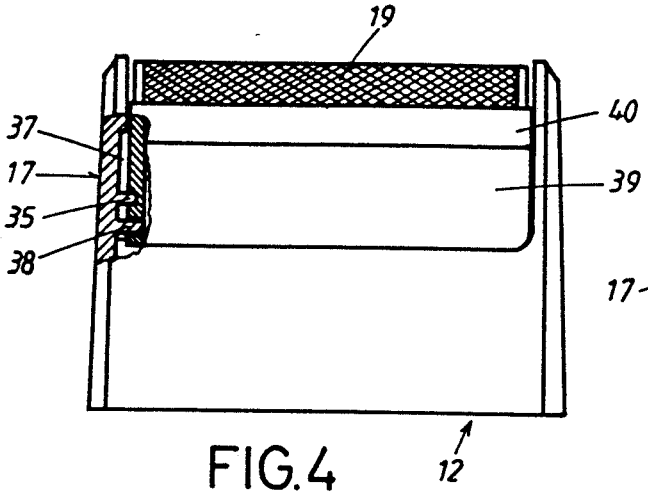
FIG. 4 is an enlarged front elevational view of the frame with the properly inserted casing, portions of the casing and of the frame being broken away to show one-half of the coupling for the casing in the operative position.
Figure 6:
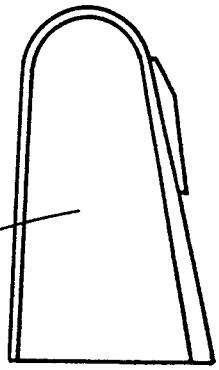
FIG. 6 is an end elevational view of the frame.
Figure 7:
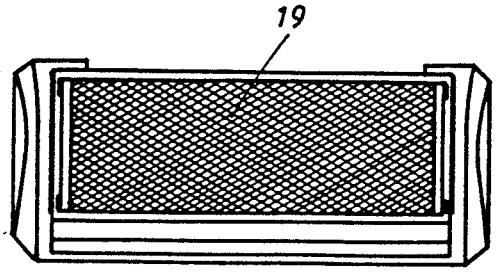
FIG. 7 is a top plan view of the structure which is shown in FIG. 4.

The electric dry shaver 10 which is shown in FIGS. 1, 2 and 3 comprises a flat elongated motor housing 11 with a forwardly tapering front portion 13, a substantially trough-shaped hollow frame 12, a hollow casing 18 for a concavo-convex apertured foil 19, and a preferably light-transmitting protective shroud or hood 25 for the foil 19. FIGS. 1 to 3 merely show those parts of the shaver 10 which are necessary for full understanding of the invention; all other parts are or can be of conventional design. The housing 11 confines a suitable electric motor (not shown) of any known design which can be started to oscillate a carrier 20 for an elongated cutter 21 serving to remove whiskers which have penetrated through the apertures of the foil 19 when the shaver 10 is fully assembled (FIG. 1) and the shroud 25 is detached from the frame 12. The housing 11 can be provided with a cord (not shown) to connect the motor with a suitable energy source. Alternatively, the housing 11 can contain a rechargeable battery for the motor. The housing 11 can be made of a plastic material and its exposed surface can be provided with suitably distributed and configurated recesses and/or raised portions so as to facilitate its manipulation when the shaver 10 is in use. FIGS. 1 to 3 merely show longitudinally extending ribs on the major portion of the housing 11 behind the front portion 13 which latter is concealed by the frame 12 when the shaver 10 is in use or in storage.

The means for separably connecting the frame 12 to the motor housing 10 comprises at least one male detent member 15 which extends from a lateral wall 14 of the front portion 13 and can be depressed by an actuator 16 which is accessible at the respective narrow side of the housing 11. The detent member 15 normally tends to move outwardly and to snap into a complementary female detent member 34 (FIG. 8) in the respective end wall or cheek 17 of the frame 12. By depressing the actuator 16, the user expels the respective male detent member 15 from the complementary female detent member 34 so that the frame 12 and the casing 18 can be detached from the housing 11. In order to reattach the frame 12, the user merely pushes the cheeks 17 of the frame along the respective walls 14 of the front portion 13 so that the male detent member or members 15 are first depressed and thereupon move outwardly to enter the respective female detent member or members 34 when the attachment of the frame 12 to the housing 11 is completed. As a rule, the means for connecting the frame 12 to the front portion 13 of the motor housing 11 will comprise two male detent members 15 and two complementary female detent members 34.

The oscillatable motor-driven carrier 20 extends forwardly through an opening in the front portion 13 of the housing 11 and is separably connected to the cutter 21 in a manner not forming part of the invention. The carrier 20 and the cutter 21 are inclined toward one of the major surfaces of the housing 11, namely toward the major surface which is adjacent a reciprocable slide 23 constituting a means for moving, starting and deactivating a trimmer 22. The purpose of separable connection between the carrier 20 and the cutter 21 is to facilitate cleaning of the cutter and/or replacement of the cutter if and when the need arises.

As indicated in FIGS. 8 and 9 by arrows A, and as also indicated by an arrow in FIG. 2, the casing 18 for the foil 19 is movable relative to the frame 17 at right angles to the longitudinal direction of the housing 11, namely toward and away from the trimmer 22. When the casing 18 is properly inserted into and coupled to the frame 12, and the latter is properly connected to the housing 11, the foil 19 is immediately adjacent the convex side of the cutter 21 so that the serving elements of the cutter slide back and forth along the concave inner side of the foil 19 in order to sever whiskers which penetrate into the interior of the casing through the apertures in the foil. In order to separate the casing 18 from the frame 12, the user must detach the frame from the housing 11 because the cutter 21 is in the way (i.e., it prevents detachment of the casing from the frame) as long as the frame 12 remains connected to the housing 11. This is in contrast to heretofore known electric shavers wherein the casing for the foil is movable in the longitudinal direction of the housing, i.e., toward or away from the convex front side of the cutter.

In accordance with a feature of the invention, the slide 23 (i.e., the means for reciprocating the trimmer 22) is movable (reciprocable) between a plurality of different positions including the retracted position which is shown in FIG. 1 by solid lines and in which the trimmer 22 is located behind the cutter 21, i.e., between the cutter and the main portion of the housing 11. In such retracted position, the motor in the housing 11 is idle so that the carrier 20 for the cutter 21 cannot oscillate and the severing elements (e.g., a row of teeth) of the trimmer 22 are also at a standstill. It is preferred to provide the housing 11 with a set of indicia adjacent the path of movement of the slide 23, and to provide the slide with a marker which is movable into register with any one of the indicia on the housing to thus indicate the selected position of the slide 23 and its trimmer 22. In one of such positions, the trimmer 22 is located at the level of the apex of the convex outer side or surface of the foil 19. The slide 22 is further movable to at least one additional position (e.g., to that in which the trimmer 23 assumes the phantom-line position of FIG. 1) in which the trimmer is disposed in front of the apex of the outer side of the foil 19, e.g., by a distance of 2 mm. Such distance can be much greater, e.g., in the range of 5–6 mm.

The arrangement may be such that, when the slide 23 is caused to leave it fully retracted position shown in FIG. 1 by solid lines, it reaches a second position in which the motor in the housing 11 is on to oscillate the carrier 20 and the cutter 21 but the cutting elements of the trimmer 22 are still idle. Moreover, the trimmer 22 is still in retracted position so that it cannot accidentally touch the skin in the course of the shaving operation. If the user decides to move the slide 23 forwardly beyond the second position to a third position, the motor in the housing 11 begins to drive the cutting elements of the trimmer 22 so that the latter is ready to trim the side burns, the moustache or the beard of the user. The slide 23 can be shifted forwardly beyond the just mentioned third position, e.g., all the way to the position in which the trimmer 22 extends forwardly and well beyond the foil 19. The cutting elements of the trimmer 22 are located in or close to the plane of the slide 22, i.e., the trimmer need not be pivotably mounted on the housing 11 but is or can be rigidly secured to the slide 23 so that it automatically assumes one of its operative positions in response to forward movement of the slide 23 toward the casing 18 and foil 19. The feature that the trimmer 22 can be shifted forwardly and beyond the apex of the outer side of the foil 19 is desirable and advantageous because the trimmer is readily observable and is not obstructed by the foil 19 when it is to be put to use to cut hairs or whiskers. The manner in which the mobile parts of the trimmer 23 can be driven by the motor in the housing 11 forms no part of the invention; in fact, the improved electric shaver can be equipped with a conventional trimmer which is pivotably mounted on the housing and whose parts can be set in motion in automatic response to pivoting from a retracted to an extended or operative position. However, the illustrated mounting of the trimmer 22 is preferred for the aforediscussed reasons, namely especially as regards its accessibility and observability.

The carrier 20 for the cutter 21 is inclined toward the trimmer 22. This can be readily seen in FIG. 2. Such orientation of the cutter 21 and carrier 20 relative to the trimmer 22 is desirable and advantageous for more convenient use of the apparatus 10 for the purposes of shaving and/or trimming. The trimmer 22 is closely or very closely adjacent the cutter 21 in response to forward movement of the slide 23 to or beyond the aforementioned third position.

The median portion of the outer side of the slide 23 is preferably provided with serrations 24 or is otherwise shaped to facilitate convenient engagement by the hand of a user. The serrations 24 which are shown in FIGS. 1 and 2 extend substantially transversely of the directions of reciprocatory movement of the slide 23 with reference to the motor housing 11. It is clear that such serrations can be replaced with otherwise configurated profiles which facilitate manipulation of the slide by the hand which holds the housing 11.

The configuration of the frame 12 is shown in FIGS. 3 to 9, especially in FIGS. 8 and 9. This frame is a one-piece body which can be made of a metallic or plastic material and is open at its rear end (in the region of the female detent member 34 in FIG. 8) as well as at its front end. The cheeks 17 of the frame 12 are rigidly connected to each other by a relatively wide first wall 33 which is immediately adjacent the open rear end of the frame 12 and extends to a window 42 which includes the open front end of the frame 12. The window 42 extends all the way between the cheeks 17 and is further bounded by a relatively narrow wall 32 which is located opposite the wall 33 and faces that portion of the window 42 which is immediately adjacent the foremost portion of the wall 33. The wall 32 also extends all the way between the cheeks 17 of the frame 12.

The curvature of those (front) portions of the cheeks 17 which project forwardly beyond the walls 32, 33 corresponds to the curvature of the foil 19 in the casing 18. The walls 32, 33 are staggered relative to each other in the longitudinal direction of the housing 11 when the latter is properly connected with the frame 12. Otherwise stated, the wall 32 is remote from but the wall 33 is immediately or closely adjacent the open rear end of the frame 12. When the frame 12 is held in the position which is shown in the righthand portion of FIG. 8, the upper edge 26 of the wider wall 33 is located at the level of the lower edge of the narrower wall 32. The wall 32 is then located at the level of a set of coupling elements which are provided at the inner sides of the cheeks 17 (i.e., in the interior of the frame 12) and cooperate with complementary coupling elements provided on the lateral walls or panels 27 of the casing 18 in order to separably couple the latter to the frame in such a way that the foil 19 overlies the cutter 21 as soon as the frame 12 is properly connected to the housing 11. The casing 18 and its foil 19 then fill the window 42 and ensure that the interior of the casing is substantially sealed from the surrounding area (except that whiskers can penetrate through the foil 19 and into the range of the oscillating cutter 21 when the shaver 10 is in use).

The coupling elements at the inner sides of the cheeks 17 of the frame 12 include elongated upper rib-shaped male coupling elements 35 which extend across the full width of the respective cheeks 17 (i.e., all the way from the wall 32 to the window portion above the wall 33) and have suitably configurated and inclined projections or locking portions 36 receivable in openings 29 provided in the respective lateral walls 27 when the casing 18 is properly inserted into the window 42. Each cheek 17 further carries a shorter male coupling element 38 in the form of a rib which is substantially parallel with and is spaced apart from the respective elongated coupling element 35. The inner side of each cheek 17 is further provided with a recess 37 which extends from the window portion above the wall 33 toward but short of the plane of the wall 32 and causes the respective cheek 17 to define a stop 45 in the form of an internal shoulder serving as a means for limiting the extent of penetration of the casing 18 into the frame 12. The end portions of the shorter coupling elements 38 are spaced apart from the walls 32, 33, and each such coupling element is receivable in a slot 43 provided in the respective lateral wall 27 of the casing 18 between an elastic prong or tine 30 and an external groove 28 for the respective elongated coupling element 35. The free end portion 31 of each prong 30 constitutes a male detent which can snap behind the properly inserted coupling element 38 in the respective slot 43. At such time, the locking portions 36 of the elongated coupling elements 35 are received in the openings 29 of the respective lateral walls 27. Each of the relatively short coupling elements 38 can slope toward the open inner or rear end of the frame 12.

The casing 18 is or can be made of a plastic material and, in addition to the lateral walls 27, comprises a first intermediate wall 39 having an elongated facet or flat 40 sloping toward the adjacent marginal portion of the foil 19. The wall 39 is relatively wide and is disposed opposite a narrower intermediate wall 41 which is provided between the open ends of the grooves 28 and the respective marginal portion of the concavo-convex foil 19.

Each of the intermediate walls 39, 41 extends all the way between the lateral walls 27. The manner in which the marginal portions of the foil 19 are secured to the respective intermediate walls 39, 41 forms no part of the present invention. For example, the marginal portions of the foil 19 can be recessed into complementary grooves at the inner sides of the intermediate walls 39 and 41. The open ends of the grooves 28 and slots 43 are adjacent the intermediate wall 41, and the openings 29 as well as the closed ends of the slots 43 are nearer to the intermediate wall 39.

When the casing 18 is moved in the direction which is indicated in FIGS. 8 and 9 by arrows A, its intermediate wall 41 enters the window 42 at a level above the wall 33 whereby the external grooves 28 slide relative to the respective coupling elements 35 until the locking portions 36 penetrate into the respective openings 29. The shorter coupling elements 38 are engaged by the projections or detents 31 of the respective prongs 30 whereby the prongs are flexed and store a certain amount of energy which is required to ensure that the detents 31 rise (as seen in FIG. 8) and snap behind the fully inserted coupling elements 38 to firmly but nevertheless releasably hold the casing 18 and its foil 19 in optimum positions with reference to the frame 12. It will be seen that insertion of the casing 18 into the frame 12 takes place in a direction other than toward and into the open front end of the frame as is customary in conventional electric shavers. This brings about the aforediscussed advantages including a considerable reduction of the likelihood of untimely or accidental separation of the casing 18 from the frame 12. Such separation can take place only when the frame 12 is already detached from the motor housing 11 because the cutter 21 practically fills the space which is bounded by the concave inner side of the foil 19 when the casing 18 is installed in the frame and the frame is attached to the housing 11. Moreover, the coupling means between the casing 18 and the frame 12 is fully concealed so that it allows for the provision of smooth external surfaces on the entire frame as well as on the intermediate walls 39, 41 of the casing.

In order to separate the casing 18 from the frame 12, the user must detach the frame 12 from the housing 11. In the next step, the user applies finger pressure against the exposed side of the wall 41 so as to expel the locking portions 36 of the coupling elements 35 from the respective openings 29 as well as to deform the prongs 30 so that the coupling elements 38 can slide along the respective detents 31 in directions to leave the respective slots 43. It will be seen that the frame 12 and/or the casing 18 need not be provided with levers, lugs, handles or like parts in order to allow for expulsion or extraction of the casing from the frame. All that is necessary is to apply to the outer side of the intermediate wall 41 of the casing 18 slight finger pressure in a direction counter to that which is indicated by arrows A so as to dislodge the locking portions 36 from the respective openings 29 and to simultaneously effect some deformation of the prongs 30 so as to enable the coupling elements 38 to leave the respective slots 43 by riding over the adjacent detents 31 at the free ends of the prongs. The elimination of the need for handles or the like as well as for fulcra (which are necessary in the aforediscussed conventional electric shavers) contributes significantly to lower cost and simplicity of the improved shaver. In addition, the likelihood of accidental separation of the casing 18 from the frame 12 is nil; in fact, such uncoupling is impossible as long as the frame remains attached to the housing 11. The manner in which one of the elongated coupling elements 35 is received in the respective groove 28 and in which the corresponding shorter coupling element 38 is then received in the respective slot 43 is shown in the left-hand portion of FIG. 4.

FIG. 3 shows that the shroud 25 (which can be made of a transparent or translucent plastic material) is provided with an internal pocket 44 which receives the trimmer 22 when the slide 23 is held in its retracted position and the shroud 25 is attached to the housing 11 and/or to the frame 12 so that it overlies and protects the foil 19 while simultaneously confining the cutting elements of the trimmer.

The coupling elements 35, 38 are formed on the respective cheeks 17 during making of the frame 12 so that they do not contribute to the cost of the frame and/or of the entire electric shaver. The same holds true for the coupling elements 28–31, 43 on and in the lateral walls 27 of the casing 18. The configuration and/or inclination of each male coupling elements 38 is selected in such a way that the respective prongs 30 are compelled to store some energy during insertion of the coupling elements 38 into the respective slots 43. This ensures that the detents 31 move behind the respective coupling elements 38 and reliably hold the casing 18 in an optimum position with reference to the frame 12 until and unless the user decides to exert a pressure upon the outer side of the intermediate wall 41 so as to again deform the prongs 30 by way of the coupling elements 38 as well as to effect expulsion of locking portions 36 of longer coupling elements 35 from the corresponding openings 29 in the lateral walls 27 of the casing 18.

The width of the walls 32, 33 and/or 39, 41 will be selected with a view to achieve savings in the material of the frame 12 and casing 18 and to ensure that the frame 12 and the casing 18 will constitute lightweight components of the shaver, while simultaneously ensuring that the parts 12 and 18 exhibit sufficient rigidity which is required from longer useful life, for proper retention of the foil 19 in the casing 18 and for proper retention of the casing in the frame. The depth of the slots 43 and the nature of the material of the lateral walls 27 determine the elasticity or yieldability of the prongs 30 and hence th magnitude of the force which is required to widen the gap between the detents 31 and the adjacent portions of the walls 27 (across the open ends of the respective slots 43) in order t allow for insertion of leading edges of the coupling elements 38 into the respective slots. The webs between the deepmost portions of the slots 43 and the intermediate wall 39 of the casing 18 act not unlike rudimentary pivots or hinges which permit necessary changes in orientation of the prongs 30 during the initial stage of introduction of the coupling elements 38 into the respective slots 43 as well as reliable return movement of the prongs 30 to their normal or starting positions in which the detents 31 partially overlie the rear edge faces of the coupling elements 38 in the respective slots 43 as soon as the casing 18 is properly coupled to the frame 12.

The improved electric shaver is susceptible of many modifications without departing from the spirit of the invention. For example, it is within the purview of the invention to provide at least some of the male coupling elements on the lateral walls 27 of the casing 18 and to provide at least some of the female coupling elements at the inner sides of the cheeks 17. Moreover, the number of male and female coupling elements can be increased or reduced, as long as these coupling elements are capable of reliably retaining the casing 18 in the window 42 when the electric shaver is in use, either for shaving or for trimming. Still further, the configuration and/or dimensions of the male and female coupling elements can be changed if such changes are desirable or necessary in order to simplify the making of the frame 12 and/or casing 18, to enhance the stability of the frame and/or of the casing and/or for other purposes. All that counts is to ensure that the casing 18 can be inserted into the window 42 of the frame 12 by moving in a direction other than from the front toward the rear end of the frame, i.e., so that detachment of the casing from the frame should be preceded by separation of the frame from the housing.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. An electric shaver comprising a motor housing having a front portion; a mobile cutter mounted in said housing and extending from said front portion; a hollow frame having a front end and an open rear end, said frame and said housing being movable relative to each other in directions to introduce said cutter into and to withdraw said cutter from said frame by way of said rear end; means for separably connecting said frame to said housing so that the frame confines said front portion; a hollow casing including an apertured foil and being insertable into said frame substantially transversely of said directions in separated condition of said frame so that the foil overlies said cutter when said frame is reconnected to said housing and said casing is inserted into said frame, said foil being disposed at the front end of said frame in inserted position of said casing; and means for separably coupling said casing to said frame.

2. The shaver of claim 1, wherein said housing is elongated and said casing constitutes or resembles a drawer which is insertable into and removable from said frame.

3. The shaver of claim 2, wherein said frame has at least one window for said casing, said window 3 being adjacent one side of said cutter when said frame is connected to said housing.

4. The shaver of claim 3, wherein said frame has two spaced-apart cheeks flanking said window, said coupling means including coupling elements provided in said frame on said cheeks and at least one of said coupling elements extending substantially transversely of said housing when the frame is connected to the housing.

5. The shaver of claim 3, wherein said frame has two spaced-apart cheeks flanking said window and said coupling means comprises male coupling elements provided on said cheeks in the interior of said frame.

6. The shaver of claim 5, wherein said male coupling elements comprise an elongated rib extending substantially transversely across each of said cheeks and having a locking portion adjacent said window.

7. The shaver of claim 6, wherein said male coupling elements further comprise a second rib provided on each of said cheeks in the interior of said frame.

8. The shaver of claim 7, wherein said second ribs are shorter than the respective elongated ribs and a portion at least of each of said second ribs slopes toward the open rear end of said frame.

9. The shaver of claim 3, wherein said frame has two spaced-apart cheeks which flank said window and at least one thereof has an inner side provided with a recess adjacent said window, said one cheek having a stop in the recess and said casing having a portion which abuts said stop in inserted position of the casing so that the stop determines the extent to which the casing is insertable into the frame by way of said window.

10. The shaver of claim 3, wherein said frame includes two spaced-apart cheeks which flank said window, a first wall extending between said cheeks, and a second wall extending between said cheeks opposite said first wall, said walls being staggered relative to each other in the longitudinal direction of said housing when said frame is connected to the housing.

11. The shaver of claim 10, wherein said first wall has a marginal portion immediately adjacent said window.

12. The shaver of clam 11, wherein said second wall is narrower than said first wall and is located opposite said window, said coupling means including coupling elements provided on said cheeks in said frame at the general level of said second wall.

13. The shaver of claim 3, wherein said coupling means comprises at least one prong provided on said casing and having a detent engageable with said frame, and at least one male coupling element provided on said frame, said casing having a groove for said male coupling element.

14. The shaver of claim 13, wherein said prong is substantially parallel to said groove, said casing having a slot intermediate said prong and said groove.

15. The shaver of claim 13, wherein said casing has an opening communicating with said groove and said male coupling element includes a projection receivable in said opening.

16. The shaver of claim 3, wherein said casing includes two lateral walls flanking said foil, a relatively wide first intermediate wall extending between said lateral walls adjacent said foil, and a relatively narrow second intermediate wall extending between said lateral walls opposite said first intermediate wall.

17. The shaver of claim 16, wherein said first intermediate wall has a facet adjacent said foil.

18. The shaver of claim 1, further comprising a trimmer provided on and movable relative to said housing, said cutter being inclined toward said trimmer.

19. The shaver of claim 18, wherein said trimmer extends transversely of the longitudinal direction of said housing and said cutter slopes in a direction from the front portion of said housing toward said trimmer.

20. The shaver of claim 19, further comprising means for reciprocating said trimmer relative to and longitudinally to said housing between a plurality of different positions.

21. The shaver of claim 20, wherein said foil has alconvex outer side with an apex which is remote from said housing when said frame is connected to said housing and said casing is inserted into said frame, said trimmer being adjacent said apex in one of said positions and extending beyond said apex in a direction away from said housing in at least one other position.

22. The shaver of claim 20, wherein said trimmer includes a plurality of severing elements and said reciprocating means is reciprocable in a predetermined plane, said severing elements being located in or close to said plane.

23. An electric shaver comprising an elongated motor housing having a front portion; a mobile cutter mounted in said housing and extending from said front portion; a hollow frame; means for separably connecting said frame to said housing so that the frame confines said front portion; a hollow casing constituting or resembling a drawer and including an apertured foil, said casing being insertable into and being remvoable from said frame in directions substantially transversely of the longitudinal direction of said housing so that the foil overlies said cutter when said frame is connected to said housing and casing is inserted into said frame, said frame having at least one window for said casing and said window being adjacent one side of said cutter when said frame is connected to the housing, said casing including two lateral walls flanking said foil, a relatively wide first intermediate wall extending between said lateral walls adjacent said foil, and a relatively narrow second intermediate wall extending between said lateral walls opposite said first intermediate wall; and means for separably coupling said casing to said frame, including a prong provided on at least one of said lateral walls adjacent said second intermediate wall, said one lateral wall having a groove disposed between said prong and said second intermediate wall and said coupling means further comprising additional coupling elements provided on said frame and including a first coupling element engageable with said prong and a second coupling element receivable in said groove.

* * * * *